US008434500B2

(12) United States Patent
Alex

(10) Patent No.: US 8,434,500 B2
(45) Date of Patent: May 7, 2013

(54) HAIR BAND

(75) Inventor: Günter Alex, Erlangen (DE)

(73) Assignee: Arcos Die Haarprofis Handels GmbH, Erlangen (DE)

( * ) Notice: Subject to any disclaimer, the term of this patent is extended or adjusted under 35 U.S.C. 154(b) by 50 days.

(21) Appl. No.: 12/850,927

(22) Filed: Aug. 5, 2010

(65) Prior Publication Data

US 2010/0294293 A1 Nov. 25, 2010

Related U.S. Application Data

(63) Continuation of application No. PCT/EP2009/000771, filed on Feb. 5, 2009.

(51) Int. Cl.
*A41G 3/00* (2006.01)
*A41G 5/00* (2006.01)

(52) U.S. Cl.
USPC ..... 132/54; 132/53; 132/201

(58) Field of Classification Search ..... 132/53–56, 132/201, 222, 273–275; 623/15.11; 434/94; 446/394; 2/182.8, 209.13, DIG. 11; 606/187
See application file for complete search history.

(56) References Cited

U.S. PATENT DOCUMENTS

| | | | | |
|---|---|---|---|---|
| 3,716,065 | A | 2/1973 | Finamore | |
| 3,848,612 | A * | 11/1974 | Kohler | 132/53 |
| 4,456,019 | A | 6/1984 | Finamore | |
| 5,213,871 | A * | 5/1993 | VanBortel et al. | 428/189 |
| 5,281,288 | A * | 1/1994 | Murray et al. | 156/83 |
| 5,722,434 | A * | 3/1998 | Walker | 132/53 |
| 5,881,737 | A * | 3/1999 | Nelson | 132/201 |
| 6,267,118 | B1 * | 7/2001 | Ito et al. | 132/201 |
| 6,405,736 | B2 * | 6/2002 | Townsend | 132/201 |
| 6,830,054 | B1 * | 12/2004 | Ross-Kuehn | 132/201 |
| 7,201,171 | B2 | 4/2007 | Sthair | |
| 7,610,921 | B2 * | 11/2009 | Gold | 132/53 |
| 7,753,057 | B2 * | 7/2010 | Kallabat et al. | 132/201 |
| 2001/0037813 | A1 * | 11/2001 | Ra | 132/53 |
| 2002/0185146 | A1 * | 12/2002 | Gold | 132/201 |
| 2004/0225314 | A1 | 11/2004 | Fukuyama | |

(Continued)

FOREIGN PATENT DOCUMENTS

| | | |
|---|---|---|
| DE | 365 353 | 12/1922 |
| DE | 876 681 B | 5/1953 |

(Continued)

OTHER PUBLICATIONS

English Translation of International Preliminary Report on Patentability in co-pending, related PCT Application No. PCT/EP2009/000771, mailed Sep. 21, 2010.

*Primary Examiner* — Vanitha Elgart
(74) *Attorney, Agent, or Firm* — Thomas | Horstemeyer, LLP

(57) ABSTRACT

A hair band (1) comprises a strip-shaped carrier structure (2) and several hairs (4) which extend from the carrier structure (2) in a main direction (5) running perpendicular to the direction (3) of main extension of the carrier structure (2). The ends (8) of single hairs are stitched through the elastic foil (6) forming the outer layer of the carrier structure (2) and fixed to the carrier structure (2) by gluing them to the foil (6) only. The fixed ends of the hairs (4), at the back side of the foil (6), also run in the main direction (5) of the hairs (4).

18 Claims, 1 Drawing Sheet

U.S. PATENT DOCUMENTS

| | | | | |
|---|---|---|---|---|
| 2005/0247324 | A1* | 11/2005 | Nicot et al. | 132/54 |
| 2005/0252517 | A1 | 11/2005 | Salinas | |
| 2005/0268928 | A1* | 12/2005 | Lane | 132/53 |
| 2006/0144413 | A1* | 7/2006 | Yoneda et al. | 132/53 |
| 2006/0169296 | A1* | 8/2006 | Gill et al. | 132/53 |
| 2007/0125399 | A1* | 6/2007 | Guliker | 132/201 |
| 2007/0157944 | A1* | 7/2007 | Catron et al. | 132/201 |
| 2009/0235948 | A1* | 9/2009 | Zephyr et al. | 132/201 |
| 2009/0260649 | A1* | 10/2009 | Sakurai et al. | 132/201 |
| 2010/0043814 | A1* | 2/2010 | Hamano | 132/107 |
| 2010/0154812 | A1* | 6/2010 | Westerman Holstijn | 132/54 |
| 2010/0170523 | A1* | 7/2010 | Depalma | 132/54 |
| 2010/0192965 | A1* | 8/2010 | Kang | 132/54 |
| 2011/0017224 | A1* | 1/2011 | Freelove | 132/54 |
| 2011/0094530 | A1* | 4/2011 | Sedillo-Beadell | 132/201 |

FOREIGN PATENT DOCUMENTS

| | | | |
|---|---|---|---|
| DE | 20 2005 010 845 | U1 | 11/2005 |
| EP | 1 642 510 | A1 | 4/2006 |
| FR | 1 401 444 | | 4/1965 |

* cited by examiner

HAIR BAND

CROSS REFERENCE TO RELATED APPLICATIONS

This application is a continuation of International Application PCT/EP2009/000771 with an International Filing Date of Feb. 5, 2009 and claiming priority to German Utility Model Application No. 20 2008 001 799.8 entitled "Haarband", filed on Feb. 8, 2008, now registered.

FIELD OF THE INVENTION

The invention generally relates to a hair band. More particularly the invention relates to a hair band which may be used for supplementing hair. The hair band may be a part of a device for supplementing hair, which is glued to the existing hair of a bearer; or it may directly be such a complete device in that it is self-adhesive.

The carrier structure of a typical hair band has a width of 1 cm at maximum, and a length of some centimeters.

BACKGROUND OF THE INVENTION

A self-adhesive hair band comprising the features of the preamble of claim 1 is known from European Patent Application Publication EP 1 642 510 A1. Here, the hairs are knotted together in strands of hair. The knots of the strands of hair are located at the back side of an elastic foil made of polyurethane through which the hairs of the strands of hair extend. The hairs are glued to the foil both at the back side and the front side of the foil. A double-faced adhesive tape is provided at the back side of this hair band, which, at its one face, is glued to the foil or to the knotted ends of the strands of hair glued to the foil, and which, at its other face, serves for gluing the hair band to natural hairs of bearer of a hair extension, for example.

Due to the knots of the strands of hair glued to the back side of the foil, the known hair band is comparatively thick, particularly if interspaces between the individual knots are filled with glue to achieve a homogenous thickness of the hair band. Further, the production of the known hair band is comparatively laborious as it requires a lot of manual work. The external optical appearance of the hair band does not correspond to the natural appearance of the human scalp due to the hair emerging out of the foil in strands, and due to the coverage of the hairs with glue even on the front side of the foil.

A further hair band is known from German Utility Model DE 20 2005 010 845 U1. Here, the hairs are glued in parallel side by side to an adhesive tape extending at a right angle to the hairs over the entire width of the adhesive tape. At the outside of this known hair band, the hairs are covered with a matte cover layer, and, if they are made of natural hair, they are provided with an anti-hygroscopic sealing in the area in which they are glued to the adhesive tape. At the other face of the adhesive tape, the known hair band may be directly glued to the hairs of the bearer of a hair extension. The adhesive layer provided here may be exchanged. This known hair band has a very flat design, and it does also only require a comparatively low effort in production, but it does also not have the appearance of a naturally haired human scalp.

Further, hair bands are known in which single hairs are knitted to a carrier netting. At its back side, the carrier netting may be glued to an intermediate foil to which a double-faced adhesive tape may be attached. In any case, knitting the hairs to the netting is extremely laborious, and does also result in an opposite orientation of the end of each hair which is bent in knitting. Here, the scales of the hair of natural hair have an opposite orientation to the scales of the desired long hair section and of the naturally existing hair of a bearer of a hair extension, and thus result in a tendency of matting of the hairs adjacent to the hair band. Further, the effective thickness of the hair band is high due to the connections of the hairs to the netting, and cutting the netting in arbitrary dimensions is not possible without endangering its integrity. At a closer look, it is also obvious that the hairs individually knitted to the netting do not provide the impression of a naturally haired human scalp.

With a large area hair replacement it is known to stitch hairs through a flexible but non-elastic PVC-foil which is formed to comply with the head form of a bearer of the hair replacement, and to glue the hairs over a greater length at the back side of the PVC-foil between the PVC-foil and an underlying cover foil. It is well known that this way of attaching the hairs is only used with artificial hair, as with natural hair there is a danger of the hairs getting loose upon absorbing moisture due to the hygroscopicity of the hairs.

With so-called training heads with natural hair it is known to stitch single hairs through the outer wall of the respective training head and to fix longer sections of the hair at the inside of this wall by means of a polyurethane foam.

A method of making wigs in which the hair is secured by a glue is known from German Patent DE 365 353 A. Here, the hairs are individually pulled through two textile layers serving as a carrier. At the back side of the inner textile layer the hairs are put together and glued to the inner textile layer by means of a resin-containing binder. The resin layer is then covered by means of a textile layer. The outer of the two textile layers serving as the carrier suitably consists of silk gauze which may be voluntarily covered according to the scalp color to be achieved. The inner textile layer consists of fish skin, a membrane made from animal origin which keeps back the binder and which is water-tight. Due to the ends of the hairs which are arranged one atop the other at the back side, this method is not suited for the manufacture of narrow hair bands. On the one hand, the hairs, in their direction of main extension, run through the textile layers serving as the carrier and at the back side of these textile layers over a distance which is greater than the width of a typical hair band. At the other hand, the multi-layered construction and the hairs lying atop the other at the back side of the carrier structure result in a considerable thickness of the known wig, that goes far beyond the tolerable thickness of a hair band which is to be attached to the natural hair of a bearer without causing attention.

A hair piece is known from U.S. Pat. No. 4,456,019, in which the hairs extend through a carriers structure in an U-bend and are glued to the back side of the carrier structure via the middle section of their U-bend. This results in a short fixation length and thus in an overall thin construction of the known hair piece. However, the hairs, in the main direction, extend from the hair piece with different running directions, i.e. with different orientations of the hair scales in natural hair. This results in an early matting of the hairs.

There still is the need of a hair band, which, on the one hand, can be manufactured at acceptable efforts, and which, on the other hand, has an external appearance which comes as close as possible to the naturally haired human scalp.

SUMMARY OF THE INVENTION

The present invention generally relates to a hair band comprising a strip-shaped carrier structure having an elastic foil forming the outer layer of the carrier structure, and displaying a direction of main extension; and several hairs having ends fixed to the carrier structure, and extending from the carrier structure in a main direction running perpendicular to the direction of main extension of the carrier structure. The ends of the hairs are individually stitched through the foil forming the outer layer of the carrier structure, and are fixed to the carrier structure by a glue-bond to the back side of the foil only, the fixed ends of the hairs, at the back side of the foil, also running in the main direction of the hairs In a more detailed aspect, the invention relates to a hair band comprising a strip-shaped carrier structure having a matte elastic plastic foil forming the outer layer of the carrier structure, and displaying a direction of main extension; and several hairs having ends fixed to the carrier structure, and extending from the carrier structure in a main direction running perpendicular to the direction of main extension of the carrier structure. The ends of the hairs are individually stitched through the foil forming the outer layer of the carrier structure, in a two-dimensional distribution of stitching through points, and they are fixed to the carrier structure by a glue-bond to the back side of the foil only, the fixed ends of the hairs, at the back side of the foil, also running in the main direction of the hairs. Further, the ends of the hairs, at the back side of the foil, are shortened to 3 mm at maximum; the carrier structure has a length in its direction of main extension of 5 cm at maximum, and a width along the main direction of the hairs of 10 mm at maximum; the ends of the hairs are covered with a single-layered cover netting at the back side of the foil; and a removable adhesive layer made of a continuous glue strip which is adhesive at both of its faces and provided with a removable cover layer at one of its faces is attached to the back side of the carrier structure.

Other features and advantages of the present invention will become apparent to one with skill in the art upon examination of the following drawings and the detailed description. It is intended that all such additional features and advantages be included herein within the scope of the present invention, as defined by the claims

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
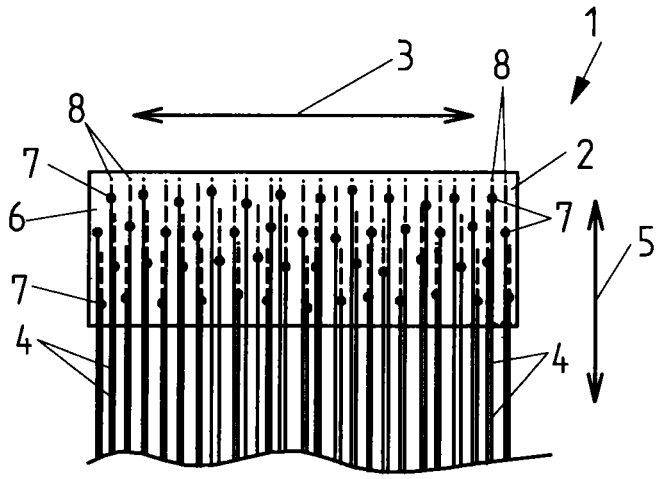
FIG. 1 is a plane view of an embodiment of the new hair band with a non-uniform two-dimensional distribution of stitching through points of the hairs of the hair band.

In the new hair band, the ends of individual hairs are stitched through the elastic foil providing the outer layer of the carrier structure, and are attached to the carrier structure by gluing them to the foil at the back side of the foil only, the hairs, at the back side of the foil, running in the direction of main extension. Due to the fact that the elastic foil directly provides the outer layer of the carrier structure, the individual hairs, which are stitched through this foil, emerge out of the foil like natural hairs out of the human scalp. In that the hairs are fixed by gluing them to the foil at the back side of the foil only, the construction of the new hair band is thin as a matter of principle. The hairs glued to the back side of the foil are not lying one atop the other. They only form a single layer. Further, an easy manufacture of the hair band is ensured. Due to the fact that the hairs, at the back side of the foil, run in the main extension of the hairs in which they extend from the carrier structure of the hair band (this main direction needs, of course, not be kept exactly), the main direction of the hairs is defined at the back side of the foil, like it also corresponds to the natural situation with the haired human scalp.

At the back side of the carrier structure, the ends of the hairs only need to extend over a little distance to ensure their secure anchoring in the new hair band. Here, the hairs may be uniformly shortened to 3 mm, 2 mm or less. The shortening of the hairs cares for that the thickness of the construction of the new hair band at the back side of the foil is increased just a little by the hairs, and that in fact only a single layer arrangement of the hairs is achieved at the back side of the foil.

With regard to its carrier structure, the new hair band may have a length in its direction of main extension of 5 cm at maximum, particularly of 4 cm at maximum but even down to 3 cm or less. The typical width of the new hair band along the main direction of the hairs is 10 mm at maximum, often 8 mm at maximum. It may also reach down to about 6 mm or even less. Due to the short anchoring length of the hairs in the carrier structure of the new hair band, these small dimensions allowing a non-obvious attachment of the hair band, are not associated with the danger that the hairs get loose from the carrier structure.

If the foil is a matte plastic foil, like for example a polyurethane foil, an appearance coming particularly close to the haired human scalp comes into existence, even if the polyurethane foil is not colored in skin color, which may, however, be additionally the case.

Making the new hair band on the basis of natural hair is particularly advantageous. Such a hair band allows for a particularly non-obvious hair extension. Due to the hygroscopic properties of natural hair, however, the strong advice has to be given that the natural hairs are anti-hygroscopically sealed in the area of their glue-connection, to avoid that the hairs non-voluntarily get loose out of their glue-connection, for example upon washing the hairs of a bearer of hair extension. The anti-hygroscopic sealing of the hairs may be a separate step in the manufacture of the new hair band, or it may be effected by means of a glue forming the glue connection to the foil.

With natural hairs, the hairs should always extend from the carrier structure in a natural root-to-tip direction to avoid matting with the natural hair of the bearer of the hair band.

In the new hair band, the hairs are stitched through the foil in a two-dimensional manner, distributed throughout the area of the foil, that is, the hairs emerge out of the foil in all areas of the foil, with certain distances between the stitching through points.

Particularly, the hairs may be stitched through the foil in a non-uniform two-dimensional distribution of their stitching through points. In principal, however, a uniform two-dimensional distribution of the stitching through points is also possible, and may merely be differentiated by an observer of the new hair band from a non-uniform distribution of the stitching through points, which corresponds to the natural situation.

With a sufficient elasticity of the foil, the hairs in the new hair band may comprise an essentially straight course in their main direction through the foil and up into the area of their glue connection to the foil. Natural hairs also are not sharply bent at the scalp.

At the back side of the foil, the ends of the hairs may be embedded in a glue providing their glue connection to the foil. This glue may provide an essentially flat end surface at the back side of the foil. Alternatively or additionally, it is possible to cover the glued ends of the hairs with a cover layer at the back side of the foil. Actually, this may be a gauze or a single-layered cover netting which does not essentially increase the thickness of the hair band but delimits the area of the glue connection of the hairs in a defined way.

At the back side of the carrier structure, i.e. on top of the cover layer mentioned above, for example, an adhesive layer may be provided to directly use the hair band for hair extension. The adhesive layer may be covered with an removable protection layer. The adhesive layer may also be removable itself to the end of exchanging it, for example, if its adhesive strength has been lost due to the influence of hair washing chemicals, or if the hair band is to be newly attached to the hairs of the bearer of a hair extension.

Actually, the adhesive layer may be made of a continuous glue strip adhesive at both faces. This means a glue strip which completely consist of the actual glue, i.e. has no additional carrier structure. Such a glue strip may adapt itself particularly well to the hairs of the bearer of a hair extension, for example, particularly if two hair bands provided with such glue strips are pressed to a strand of the hairs of the bearer of the hair extension from two opposing sides.

Referring now in greater detail to the drawings, FIG. 1 shows a hair band 1 with a strip-shaped carrier structure 2 which extends in a direction 3 of main extension. In the plane view according to FIG. 1, the carrier structure is of rectangular shape, the ratio between its length in the direction 3 of main extension and its width within the drawing plane and perpendicular to the direction 3 of main extension may also deliberately deviate from that one shown in FIG. 1.

Several hairs 4 extend from the carrier structure 2 in a main direction 5 running perpendicular to the direction 3 of main extension. The hairs 4 emerge out of an elastic polyurethane foil 6 which forms the outer layer of the carrier structure 2 in stitching through points 7. The distribution of the stitching through points 7 over the area of the foil 6 is a non-uniform two-dimensional distribution in which, however, the distances of the stitching through points 7 with regard to each other are about the same. The ends 8 of the hairs 4, which, in FIG. 1, are depicted with dashed lines, as they are not directly visible there, are glued to the back side of the foil 6. In the area of this glue connection to the back side of the foil 6 they also run in the main direction 5.

Figure 2:
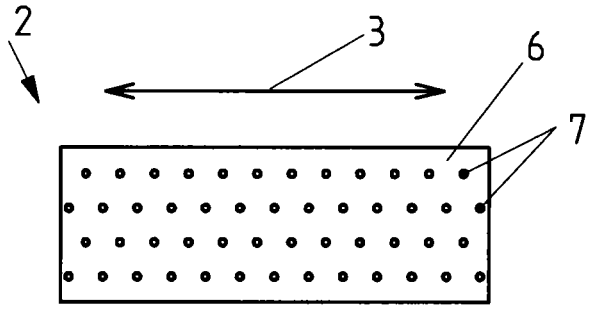
FIG. 2 shows a uniform distribution of stitching through points.

FIG. 2 sketches a uniform distribution of the stitching through points 7 over the area of the foil 6, which may make it easier to stitch the hairs 4 according to FIG. 1 through the foil 6 by means of a machine, and which does in practice not deviate from the non-uniform distribution according to FIG. 1 with regard to its optical appearance.

Figure 3:
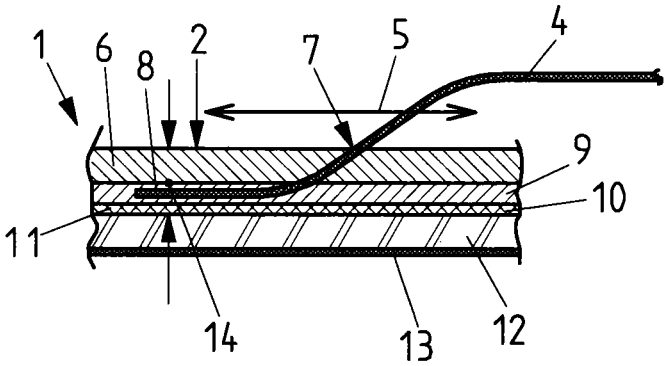
FIG. 3 is a cross-section through a partial area of an embodiment of the new hair band, which is attributed to one hair, with an adhesive layer at the back side of its carrier structure.

FIG. 3 sketches the course of a single hair through the foil 6 of the carrier structure 2 and the back layers of the carrier structure 2 in a section along the main direction 5. Even behind the stitching through point 7 of the hair 4, i.e. through the foil 6, the hair 4 essentially runs in the main direction 5. On the back side of the foil 6 the end 8 of the hair 4 is embedded in a glue 9 which glue-connects the end 8 of the hair 4 to the foil 6 and which also anti-hygroscopically seals the end 8 of the hair 4. The glue 9 with the embedded ends 8 of the hairs 4 is covered by a cover layer 10 in the form of a single layer cover netting 11 which is also glued with the glue 9 and may be impregnated with the glue 9. A continuous glue strip 12 adhesive at both faces, which is covered with a removable cover layer 13 at its back side, is arranged at the back side of the cover layer 11. The continuous glue strip 12 may be separated from the remaining construction of the carrier structure 2 to replace it with a new glue strip without endangering the integrity of the carrier structure 2.

The dimensions of the new hair band 1, which are depicted in the drawings, do not necessarily correspond to the natural conditions, even not with regard to each other. The entire construction of the new hair band has a surprisingly low thickness 14 of the carrier structure from the outside of the foil 6 up to the back side of the cover layer 11. The optical appearance of the new hair band with regard to the connection of the hairs to the carrier structure nearly identically corresponds to the appearance of a naturally haired human scalp. The manufacture of the new hair band may, without further measures, take place in that at first a corresponding two-dimensional material with much greater dimensions both in the direction 3 of main extension and in the main direction 5 than needed for a single hair band is manufactured, and that this starting material is then cut in single hair bands 1 and provided with glue strips 12. The anchoring of the hairs 4 via the glue connection of their ends 8 to the back side of the foil 6 is sufficiently secure, even if the ends 8 of the hairs 4 at the back side of the foil 6 are shortened in this process, as it is the case with the hairs 4 whose stitching through points 7 are located at the upper boundary of the carrier structure 2 according to FIG. 1.

Many variations and modifications may be made to the preferred embodiments of the invention without departing substantially from the spirit and principles of the invention. All such modifications and variations are intended to be included herein within the scope of the present invention, as defined by the following claims.

I claim:

1. A hair band comprising:

a strip-shaped carrier structure having an elastic foil forming an outer layer of the carrier structure, and having a direction of main extension; and several hairs having ends fixed to the carrier structure, and extending straight through from the carrier structure in a main direction running perpendicular to the direction of main extension of the carrier structure;

wherein the ends of the hairs are individually stitched through the foil forming the outer layer of the carrier structure, the hairs individually stitched through in a two-dimensional distribution of stitching through points and are fixed to the carrier structure by a glue-bond to the back side of the foil only, the fixed ends of the hairs, at the back side of the foil, running straight through in the main direction of the hairs from the glue-bond of their ends through the foil to the main direction of the hairs generally perpendicular to the direction of the main extension of the carrier structure.

2. The hair band of claim 1, wherein the ends of the hairs, at the back side of the foil, are shortened to 3 mm at maximum.

3. The hair band of claim 1, wherein the ends of the hairs, at the back side of the foil, are shortened to, particularly to 2 mm at maximum.

4. The hair band of claim 1, wherein the carrier structure has a length in its direction of main extension of 5 cm at maximum, and a width along the main direction of the hairs of 10 mm at maximum.

5. The hair band of claim 1, wherein the carrier structure has a length in its direction of main extension of 4 cm at maximum, and a width along the main direction of the hairs of 8 mm at maximum.

6. The hair band of claim 1, wherein the foil is a matte plastic foil.

7. The hair band of claim 1, wherein the foil is a matte polyurethane foil.

8. The hair band of claim 1, wherein the hairs are natural hairs anti-hygroscopically sealed in the glue-bond.

9. The hair band of claim 1, wherein the hairs are natural hairs extend from the carrier structure in a natural root-to-tip direction.

10. The hair band of claim 1, wherein the ends of the hairs are stitched through the foil in a non-uniform two-dimensional distribution of stitching through points.

11. The hair band of claim 1, wherein the ends of the hairs are embedded in a glue gluing them to the foil.

12. The hair band of claim 1, wherein the ends of the hairs are covered with a cover layer at the back side of the foil.

13. The hair band of claim 12, wherein the cover layer is a single-layered cover netting.

14. The hair band of claim 1, wherein an adhesive layer is provided at the back side of the carrier structure.

15. The hair band of claim 14, wherein the adhesive layer is provided with a removable cover layer.

16. The hair band of claim 14, wherein the adhesive layer is removable.

17. The hair band of claim 16, wherein the adhesive layer is made of a continuous glue strip which is adhesive at both of its faces.

18. A hair band comprising:

a strip-shaped carrier structure having a matte elastic plastic foil forming an outer layer of the carrier structure, and having a direction of main extension; and several hairs having ends fixed to the carrier structure, and extending straight through the carrier structure in a main direction running perpendicular to the direction of main extension of the carrier structure;

wherein the ends of the hairs are individually stitched through the foil forming the outer layer of the carrier structure, the hairs individually stitched through in a two-dimensional distribution of stitching through points, and the ends of the hairs are fixed to the carrier structure by a glue-bond to the back side of the foil only, the fixed ends of the hairs, at the back side of the foil, running straight through in the main direction of the hairs from the glue-bond of their ends through the foil to the main direction of the hairs generally perpendicular to the main extension of the carrier structure;

wherein the ends of the hairs, at the back side of the foil, are shortened to 3 mm at maximum;

wherein the carrier structure has a length in its direction of main extension of 5 cm at maximum, and a width along the main direction of the hairs of 10 mm at maximum;

wherein the ends of the hairs are covered with a single-layered cover netting at the back side of the foil; and wherein a removable adhesive layer made of a continuous glue strip which is adhesive at both of its faces and provided with a removable cover layer at one of its faces is attached to the back side of the carrier structure.

* * * * *